US009340261B2

(12) United States Patent
Macrae

(10) Patent No.: US 9,340,261 B2
(45) Date of Patent: May 17, 2016

(54) ANCHOR LINE TENSIONING METHOD

(75) Inventor: Michael Macrae, Nice (FR)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 14/130,976

(22) PCT Filed: Jul. 4, 2012

(86) PCT No.: PCT/EP2012/063042
§ 371 (c)(1),
(2), (4) Date: Feb. 20, 2014

(87) PCT Pub. No.: WO2013/004749
PCT Pub. Date: Jan. 10, 2013

(65) Prior Publication Data

US 2014/0216323 A1 Aug. 7, 2014

(30) Foreign Application Priority Data

Jul. 6, 2011 (EP) ..... 11172920

(51) Int. Cl.
*B63B 21/50* (2006.01)

(52) U.S. Cl.
CPC ..... *B63B 21/50* (2013.01); *B63B 2021/505* (2013.01); *Y10T 29/49826* (2015.01)

(58) Field of Classification Search
CPC ..... B63B 21/04; B63B 21/24; B63B 21/50
USPC ..... 114/210, 230.21, 293
See application file for complete search history.

(56) References Cited

U.S. PATENT DOCUMENTS 6,983,714 B2 * 1/2006 Dove et al. ..... 114/293
7,059,262 B2 6/2006 Dove et al.

FOREIGN PATENT DOCUMENTS

EP 0 194 717 9/1986
WO 03/013950 2/2003
WO 2010/127220 11/2010

OTHER PUBLICATIONS

International Search Report dated Sep. 17, 2012, corresponding to PCT/EP2012/063042.

* cited by examiner

*Primary Examiner* — Lars A Olson
(74) *Attorney, Agent, or Firm* — Young & Thompson

(57) ABSTRACT

Method for mooring an offshore structure includes:
providing a mooring line having one end connected to the sea bed and a connector at a free end;
lifting the free end onto a deck of an anchor line handling vessel;
connecting on the anchor line handling vessel a chain tensioner with a connection side to the connector;
providing a working chain having a short tensioning part and a long installation part into the entry side of the chain tensioner;
holding a free end of the installation part while lowering the chain tensioner below water level;
picking up a free end of a pendant attached to the offshore structure, and attaching it to the free end of the installation part in an interconnect position on the anchor line handling vessel;
placing the interconnect position overboard;
connecting a lifting cable on the anchor line handling vessel to the tensioning part below water level; and
exerting an upward tensioning force on the tensioning chain part.

10 Claims, 15 Drawing Sheets

ANCHOR LINE TENSIONING METHOD

FIELD OF THE INVENTION

The invention relates to an anchor line tensioning method for mooring a floating offshore structure, such as a floating production storage and offloading system (FPSO), a semi-submersible platform, a loading/offloading buoy or any other floating structure, to the sea bed. The invention also relates to a floating offshore structure having a mooring line configuration for carrying out the anchor line installation method.

BACKGROUND OF THE INVENTION

From WO 03/013950 in the name of the applicant, an anchor line installation method is known according to which a pre-installed anchor line carrying a connector at its free end, is retrieved by the installation vessel. The connector may be formed by a chain stopper so that it functions as a chain tensioner device. A pulling line attached to a winch on the installation vessel is guided along a sheave on the chain tensioner device on board of the installation vessel. The installation vessel also picks up a free pendant end that is connected to the floating structure and the pulling line is connected to this free pendant end. The chain tensioner device is over boarded and is connected below water level with the pendant by hauling in the pulling wire on the winch.

By placing the chain tensioner device externally from the moored structure, in line with the anchor leg, the installation and commissioning of the tensioning system is removed from the construction yard schedule of the moored structure. Also, a reduction in chain table size and removal of installation aids from the turret is achieved in case the chain tensioner is used in turret-moored offshore structures. For spread-moored FPSO's, utilising the known external in-line tensioner results in space saving at the topside due to the absence of tensioner devices such as chain jacks and chain stoppers and the absence of storage space for excess installation chain. Furthermore, no maintenance is required on chain jacks on the moored offshore structure and during re-tensioning operations no disruption of the production and processing operations occurs.

The known method has as a disadvantage that the pendant that is connected to the floating structure has a relatively long length, which makes it difficult to store on and to deploy it from the floating structure. Furthermore, checking for a proper connection between the known chain tensioner device and the pendant requires underwater inspection, such as by divers. If for some reason a proper connection between the pendant and the tensioner device is not made, the connection operation needs to be interrupted.

From U.S. Pat. No. 7,059,262 a mooring line connection method is known wherein a pre-installed mooring line with at its free end a clamping device is placed on the sea-bed.

The clamping device comprises a slotted sheave or pulley and a chain stopper that is attached to a recovery pendant and a submersed buoy. The buoy is attached to a pull in wire on an anchor-handling vessel via a ROV and the clamping device is hoisted on board of the handling vessel. On board of the vessel the pendant from the floating structure, having at its free end a chain part, is pulled through the clamping device, and is attached to the pulling wire. Next, the clamping device is over boarded and the mooring line is pulled upward such that the pendant chain part moves along the chain stopper of the clamping device that functions as a ratchet allowing only one directional movement of the chain, until the right tension in the mooring line is achieved.

In the known method, the connection between the chain tensioner and the chain part of the pendant connected to the floating structure is made below water level, which results in difficult control over the connection procedure. Also abandoning the clamping device on the seabed may cause ingress of sand or small stones into the clamping device resulting in malfunctioning or blocking of the tensioner device. Again, the relatively long length of the pendant connected to the floating structure in this mooring line installation method results in relatively difficult handling.

SUMMARY OF THE INVENTION

It is therefore an object of the present invention to provide an anchor line installation method, which allows controlled and easily monitored connection of the mooring line that is attached to the seabed, to the pendant connected to a floating structure.

It is a further object of the present invention to provide an anchor line installation method, which allows easy handling of the pendant segment connected to the floating structure.

It is again an object of the invention to provide an anchor line installation method in which the risk of malfunctioning of the chain tensioner device is mitigated.

It is another object of the present invention to provide an anchor line tensioning method allowing controlled tensioning of the anchor lines using anchor handling vessels having relatively low-powered engines.

Hereto an anchor line installation method according to the present invention comprises the steps of:

- Providing a mooring line, with one end connected to the sea bed and comprising at a free end a connector member,
- Lifting the free end onto a deck of an anchor line handling vessel,
- Connecting on the anchor line handling vessel a chain tensioner with a connection side to the connector member,
- Providing a working chain into the entry side of the chain tensioner, the working chain having a relatively short tensioning chain part and a relatively long installation chain part,
- Holding a free end of the installation chain part connected to the anchor line handling vessel while lowering the chain tensioner below water level,
- Picking up a free end of a pendant attached on one end to an offshore structure that is to be moored, and attaching the free end of the pendant to the free end of the installation chain part in an interconnect position on the anchor line handling vessel,
- placing the interconnect position over board from the anchor line handling vessel,
- Connecting a lifting cable of a lifting device on the anchor line handling vessel to tensioning chain part below water level, and
- Exerting an upward tensioning force on the tensioning chain part via the lifting cable.

The chain tensioner is fixedly attached to the mooring line with its connecting end on board of the anchor line handling vessel, and does not come into contact with the sea bed such that ingress of sand or stones is avoided.

The tensioning chain part is passed through the chain tensioner on board of the anchor line handling vessel, which allows for a controlled operation with good possibilities of diverless visual inspection.

The use of the tensioning chain part that is attached with its upper end to the pendant connected to the floating structure, allows that the pendant can be a relatively short line section connected to the floating structure, such that handling thereof is facilitated. The anchor leg connected to the chain tensioner can be for the largest part made of synthetic rope material, such as polyester of a length of 1000 m or more, for instance suitable for deep water of a depth of several thousands of meters. Using the method of the invention, re-tensioning of such synthetic anchor lines now is possible to compensate for creep elongation over time by pulling in a new installation chain part.

In an embodiment, the installation chain part of the working chain is at least 0.5 times the length of the pendant, preferably at least 1 times the length of the pendant, most preferably at least 1.5 times the length of the pendant. The pendant can be formed of a chain, steel or polyester wire rope or combinations thereof. The free ends of the pendant and installation chain part can be interconnected via releasable bow shackles, chain links or any other suitable connector devices. It is for instance within the scope of the invention that the installation chain part comprises at its free end a cable with an eye for connecting to an eye on a cable at the free end of the pendant.

In a further embodiment of a method according to the invention, the anchor line handling vessel is connected to the offshore structure in a holding point via a holding line that is connected to a pulling device on the anchor line handling vessel, wherein an upward tensioning force is exerted on the tensioning chain part by the pulling device exerting a pulling force on the anchor line handling vessel in the direction of the offshore structure via the holding line.

By horizontally pulling the anchor line installation vessel, for instance via its stern, in the direction of the moored structure, it does not have to use the full power of its thrusters to generate a horizontal force upon tensioning the mooring line via the pulling device. In this manner, a larger selection of anchor line handling vessels having smaller sized engines can be used. Furthermore, anchoring the handling vessel against the offshore structure in a fixed horizontal position provides a stable and safe tensioning configuration in which the tensioning operation can be properly controlled.

In a further embodiment of a method according to the invention, the length of the holding line is shorter than a horizontal distance of the tensioner to the holding point such that the tensioning chain part extends substantially in line with the mooring line.

Preferably the holding line keeps the installation vessel in a such a horizontal position that the chain tensioning part and the pulling line extend within an angle of at most +/−30 degrees around the operational direction of the upper part of the anchor leg, preferably in line with it, such that during tensioning forces are exerted on the anchor in a direction corresponding to the in-use forces. Hereby it is achieved that the anchor is pulled in line with the direction of regular use, and can in that direction provide an optimal anchoring force as many anchors, such as drag anchors, fluke anchors or suction piles, are relatively sensitive to the direction of the tension load.

Preferably the holding point on the moored structure is situated above water level and the holding line extends substantially in a horizontal direction to the installation vessel.

In a preferred embodiment of a moored offshore structure according to the invention, the mooring point is situated in a lower half of the moored structure, for instance on a submerged turret moored buoy, a chain table of the turret or on the hull of the structure.

In case of connection to the lower part of the hull, for instance via a uni-joint, the anchor line connection is subject to reduced fatigue compared to connection to a known gypsy wheel and chain jack tensioner device on deck of the vessel.

BRIEF DESCRIPTION OF THE DRAWINGS

An embodiment of an anchor line tensioning method according to the invention will by way of non-limiting example be described in detail with reference to the accompanying drawings. In the drawings.

DETAILED DESCRIPTION OF THE INVENTION

Figure 1:
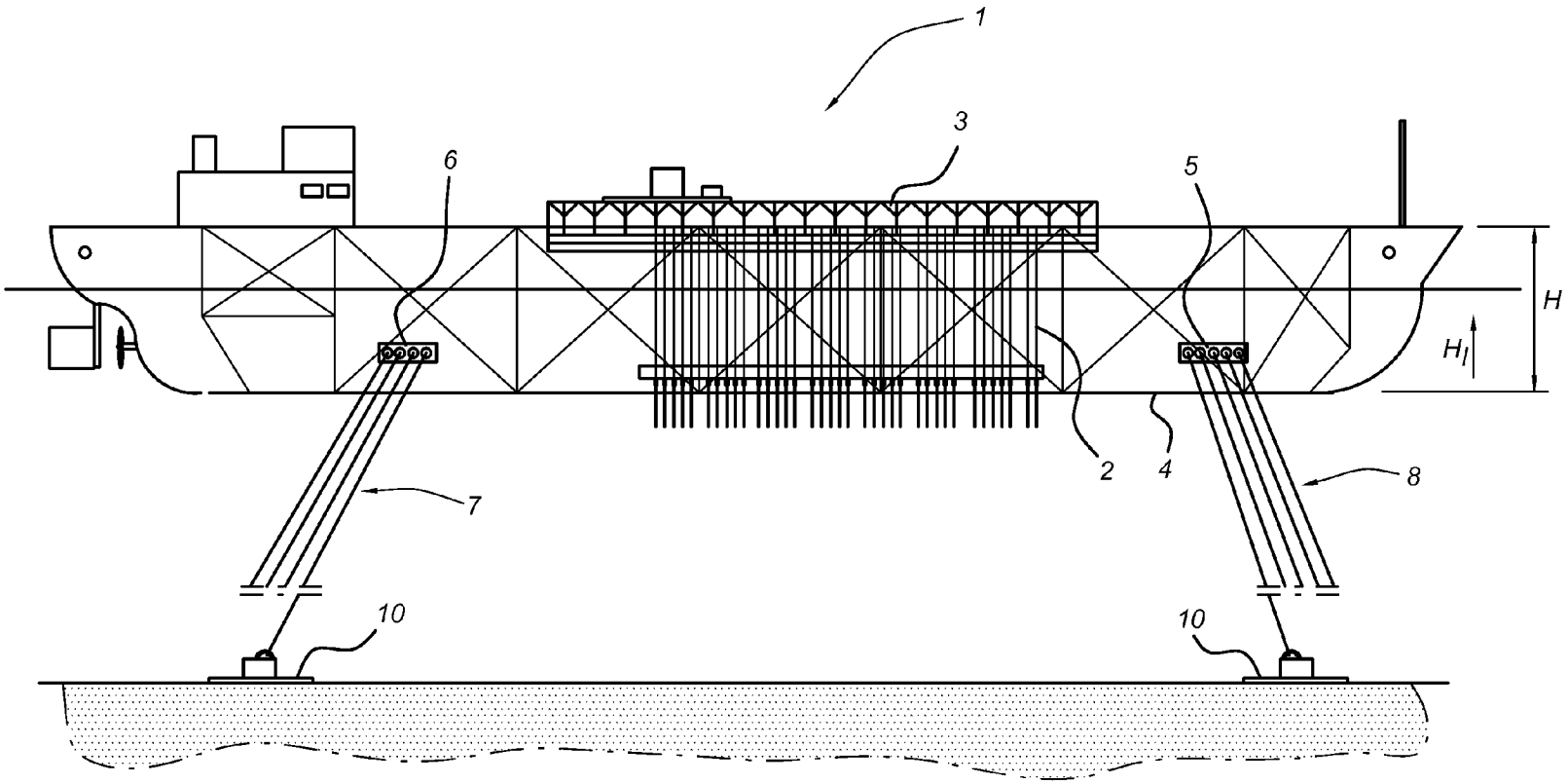
FIG. 1 shows a side view of an FPSO anchored to the sea bed utilising a mooring leg configuration according to the present invention.

FIG. 1 shows a moored offshore structure 1 according to the invention in the form of a spread-moored FPSO. The FPSO carries a number of hydrocarbon production risers 2 attached with their lower ends to a sub sea hydrocarbon well and with their upper ends supported near a deck 3 and in fluid connection with storage and/or processing equipment on board of the FPSO 1. The FPSO is anchored in a lower half $H_l$, of its height H between keel level 4 and the level of deck 3. In the lower half $H_l$, the FPSO is provided with anchoring points 5,6 on its hull. In the anchoring points 5,6 the FPSO is connected via uni-joints to groups of anchor legs 7,8 which with their lower ends are anchored to the sea bed 10 via anchors or suction piles. Although the embodiment in FIG. 1 shows a spread-moored FPSO, the invention is also applicable to other mooring configurations, such as for instance turret-moored constructions, structures moored via a disconnectable submerged buoy and to other offshore structures such as Floating Storage and Regasification Units (FSRU's) for processing of liquefied natural gas, semi-submersible structures, single point mooring buoys and the like.

Figure 2:
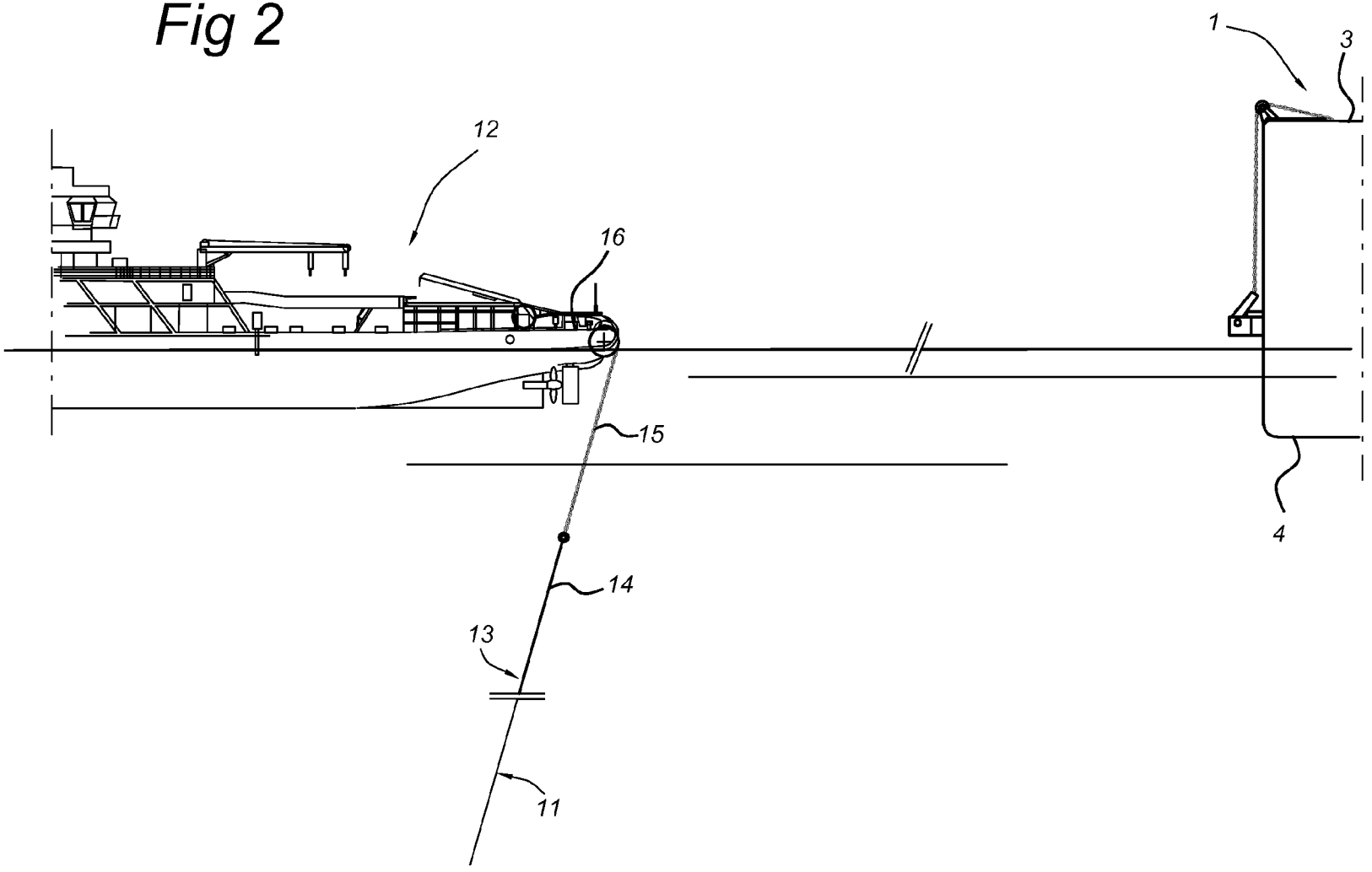
FIG. 2 shows a the first stage of an anchor line tensioning method according to the invention.

FIG. 2 shows a side view of a first stage of the anchor leg connection and tensioning procedure according to the invention. In FIG. 2, the anchor leg 11 may be installed, tensioned and be picked up by the anchor line handling vessel 12 or may be have been pre-installed by another vessel and connected to the seabed 10 and tensioned in the prior step. The anchor line handling vessel 12 picks up the top part 13 of the anchor leg 11, which top part may comprise a polyester rope section 14 and a chain section 15, for instance of a length of 20 m. The chain section 15 is clamped in a clamping device 35 (see FIGS. 7, 9 and 10) at the stern 16 on deck of the vessel 12.

Figure 3A:
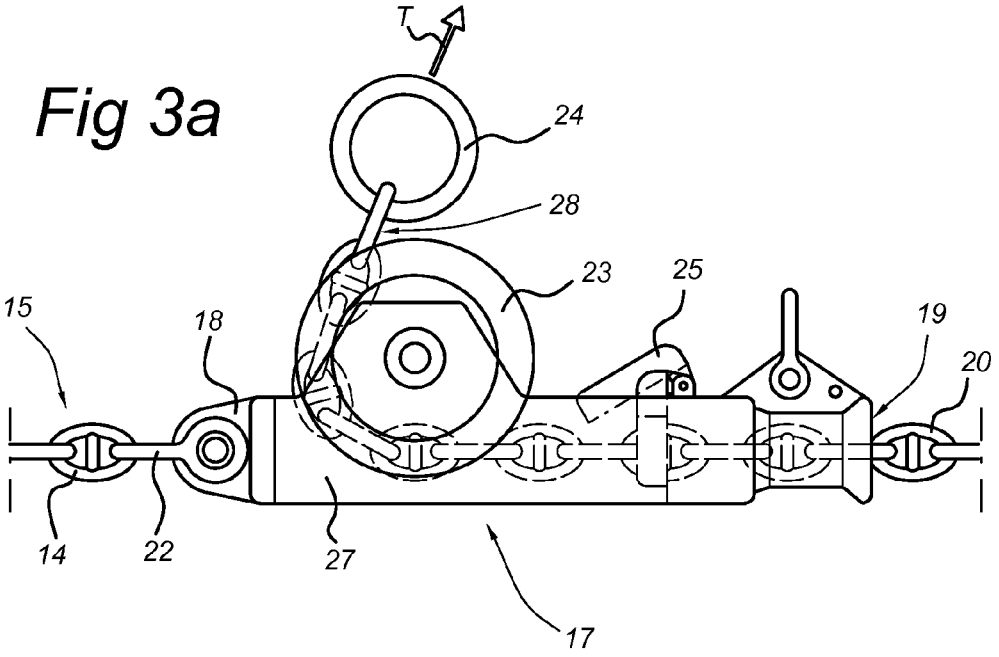
FIGS. 3*a* and 3*b* show a side view and a top view of a chain tensioner for use in the tensioining method of the invention.
Figure 3B:
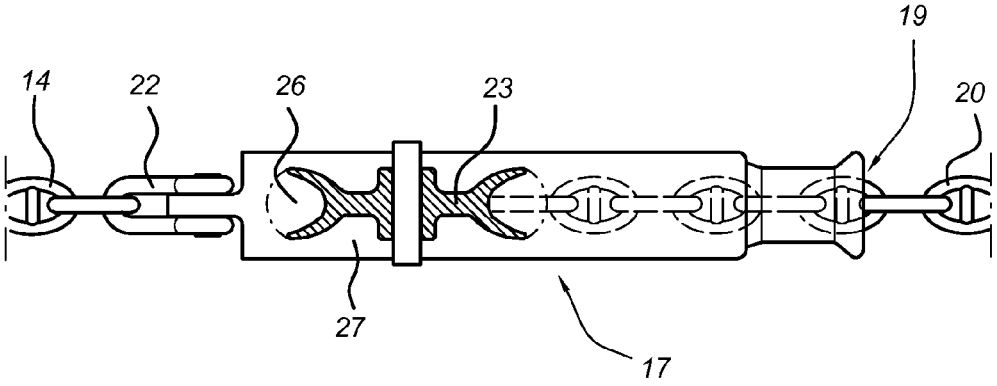

As shown in FIGS. 3*a*, 3*b*, on deck of the vessel 12, a chain tensioner 17 is fixedly attached with a connection side 18 to the upper end of the chain section 15 via a chain link 14 and connector member, such as a bow shackle 22. It is also envisaged that instead of chain section 15, a wire rope or other line section is utilised to connect to side 18 of the chain tensioner device 17 using a suitable connector member. During connection of the upper end of chain section 15 to the chain tensioner device 17, the chain section 15 remains clamped on deck of the vessel 12. A working chain 20, having a length of for instance 200 m, is on deck of the vessel 12 movably passed through the chain tensioner 17, by feeding tensioning chain section 28 that is formed by the lower part of the working chain 20 via an entry side 19 of the chain tensioner through a chain stopper 25 and along a sheave 23. The chain stopper 25 functions as a ratchet and only allows passage of the working chain 20 through the tensioner housing 27 in the direction of the shorter tensioning chain part 28, that becomes longer upon pulling it in the direction indicated as T. The tensioning chain part 28 of the tensioning chain 20 is guided via the rotatable sheave 23 out through an opening 26 (see FIG. 3*b*) in the housing 27 of the chain tensioner 17. A pulling eye 24 of relatively large diameter is attached to tensioner chain part 28 for handling by a remote operated vehicle (ROV).

Figure 4:
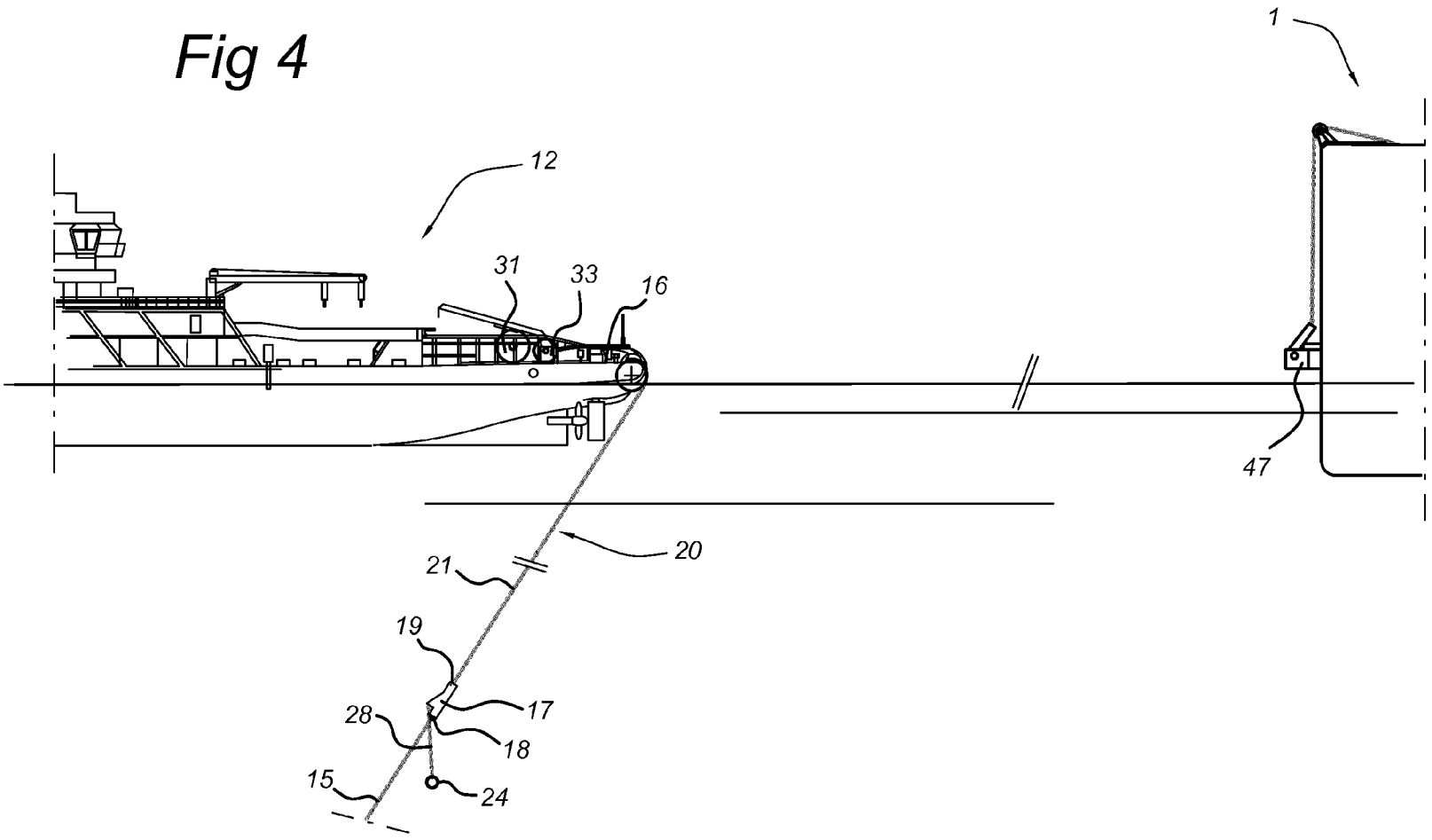
FIGS. 4-6 show side views of further stages of bringing together the pendant chain and the installation chain part on the anchor line handling vessel.
Figure 5:
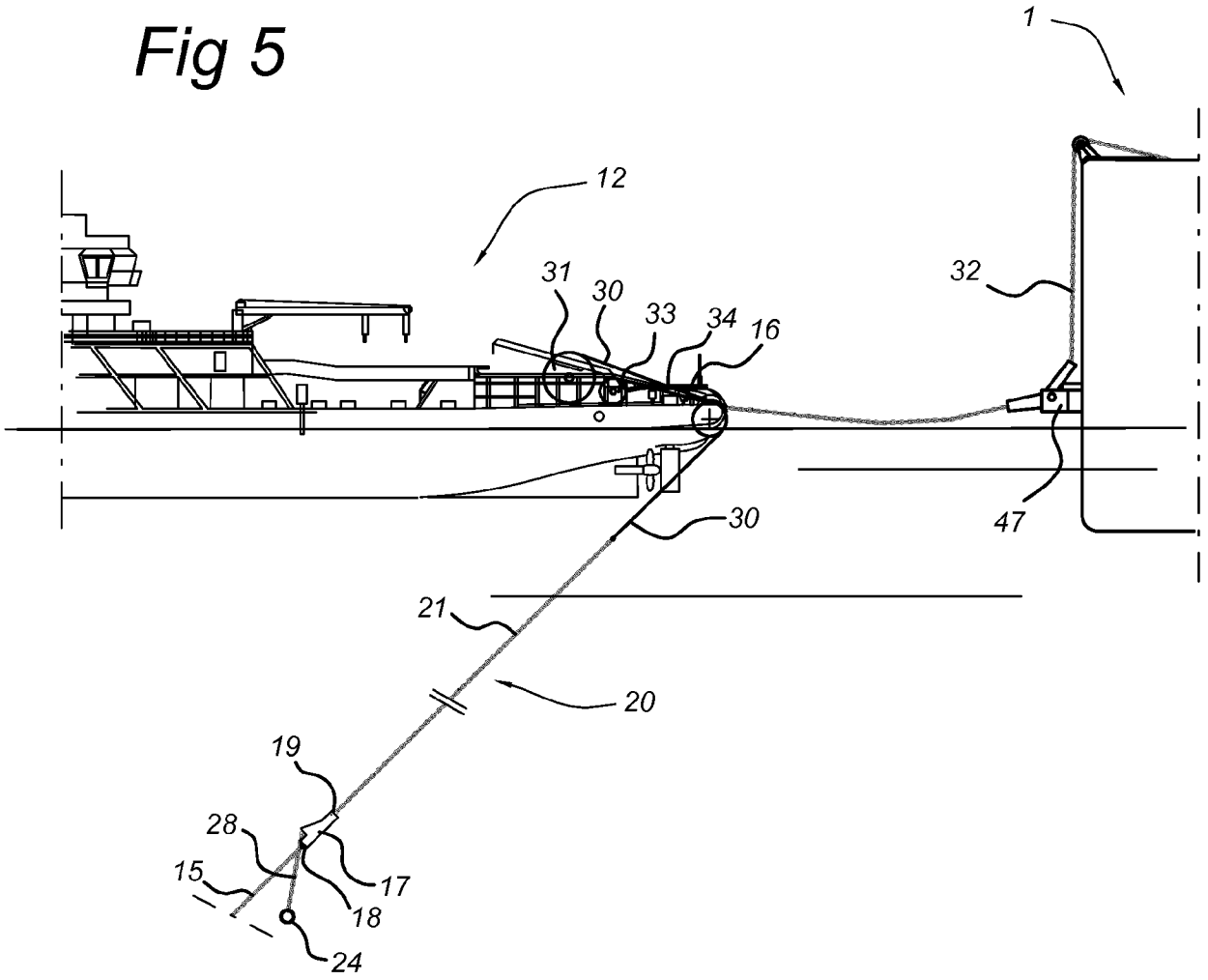

Next, as can be seen in FIG. 4, the working chain 20 is attached to a work wire 30 on the anchor line-handling vessel 12, the work wire 30 being wound on the drum of a main winch 31, and the chain tensioner 17 is over boarded. The working chain 20 is paid out via the work wire 30 via the main winch 31, while the vessel 12 moves rearwards towards the FPSO 1.

Figure 7:
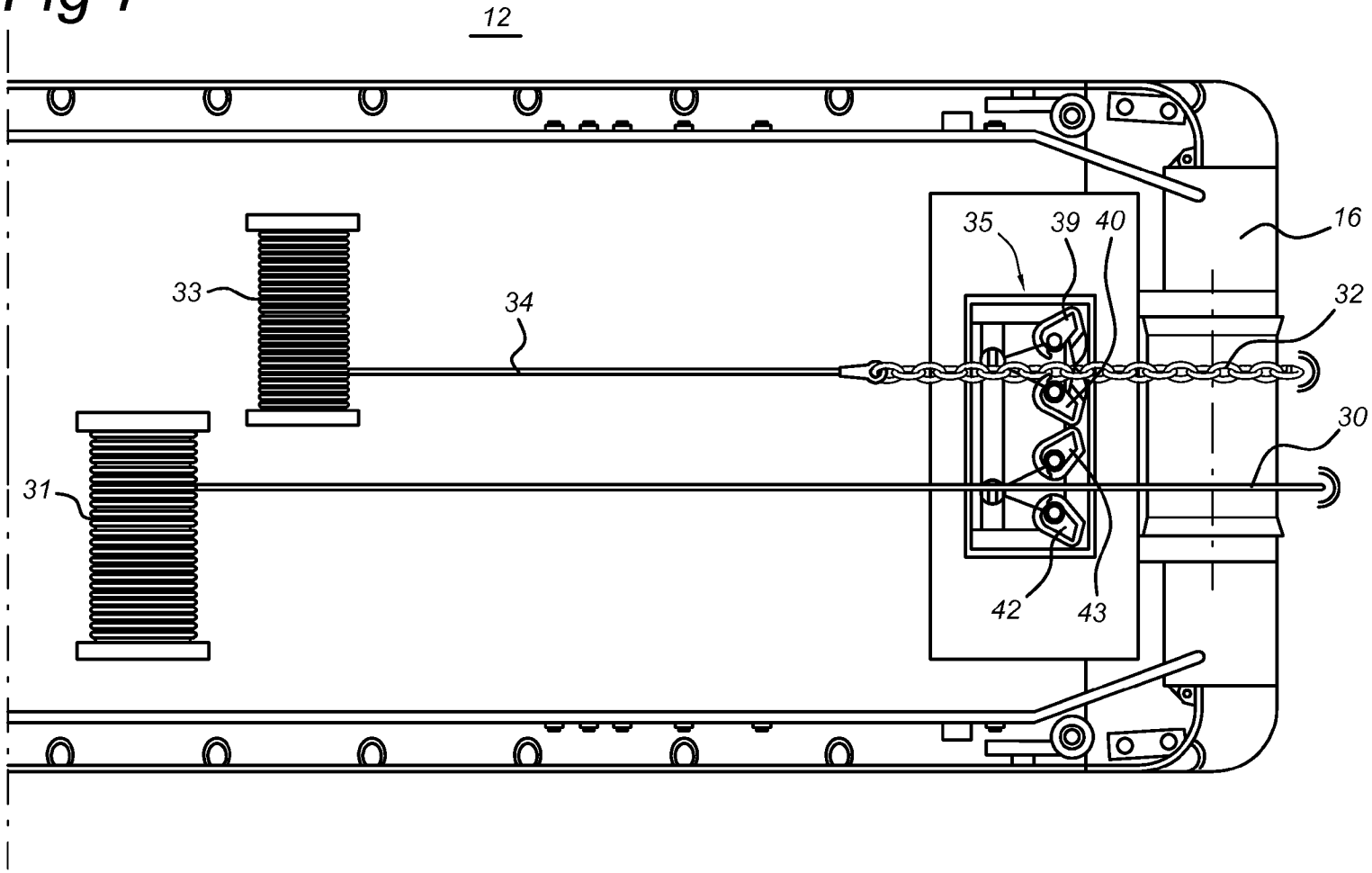
FIG. 7 shows a top plan view of the stern part of the anchor line handling vessel, the pendant chain and the installation chain part being attached to respective winches on the vessel.

From the FPSO 1, a pre-installed pendant chain, or chain tail 32 is recovered and is attached to a tugger winch 33 on the vessel 12 via a tugger winch wire 34 (see FIG. 7).

Figure 6:
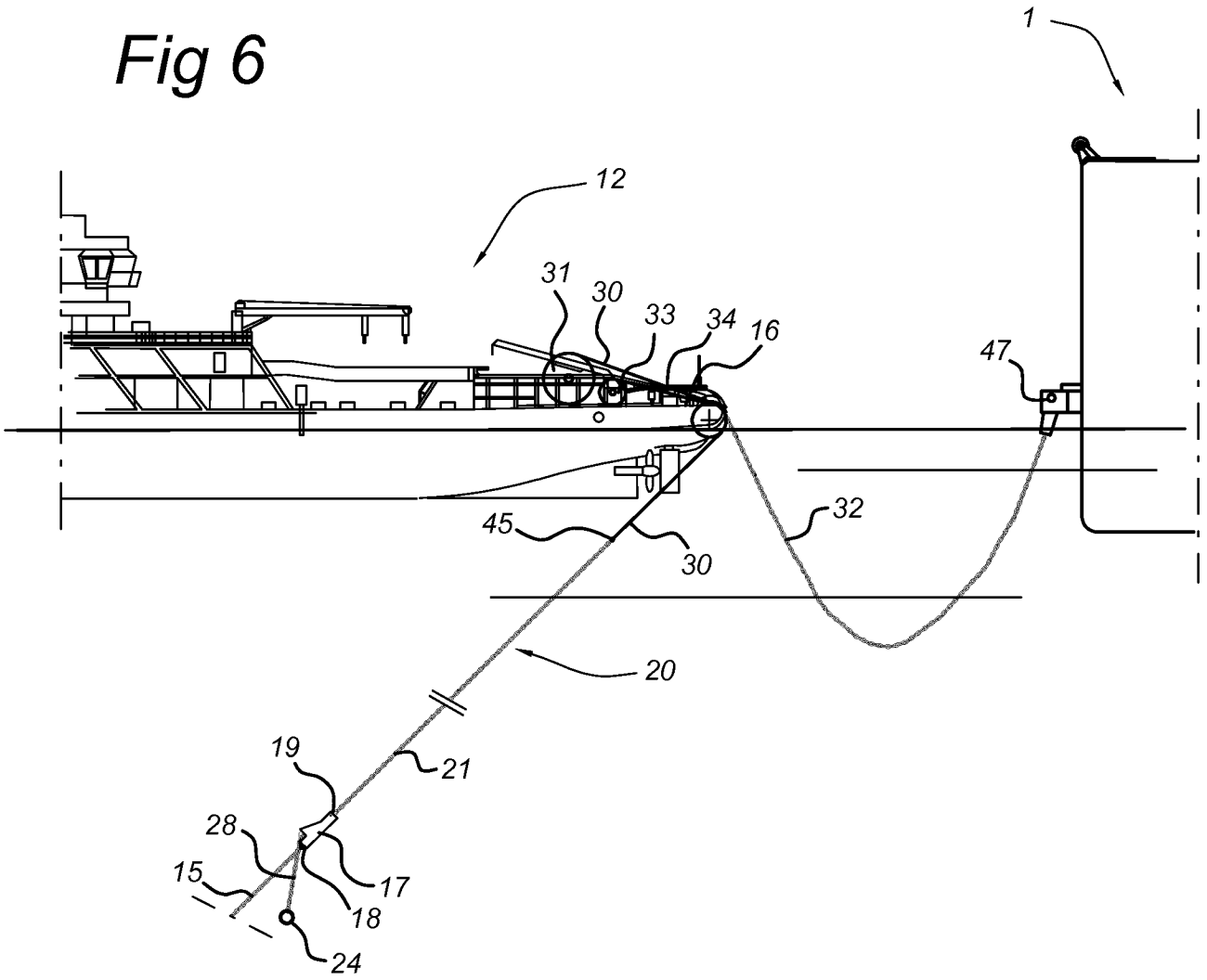

As can be seen in FIG. 6 and FIG. 7, the pendant chain 32 is paid out from the FPSO 1 and is recovered on the stern 16 of the vessel 12 where it is fixed in the clamping device 35, between movable jaws 39,40. Next, the anchor line-handling vessel 12 is moved away from the FPSO 1 to recover the free end 45 of the working chain 20 to the deck of the vessel 12. The tugger winch wire 34 may be paid out from winch 33 as required.

Figure 8:
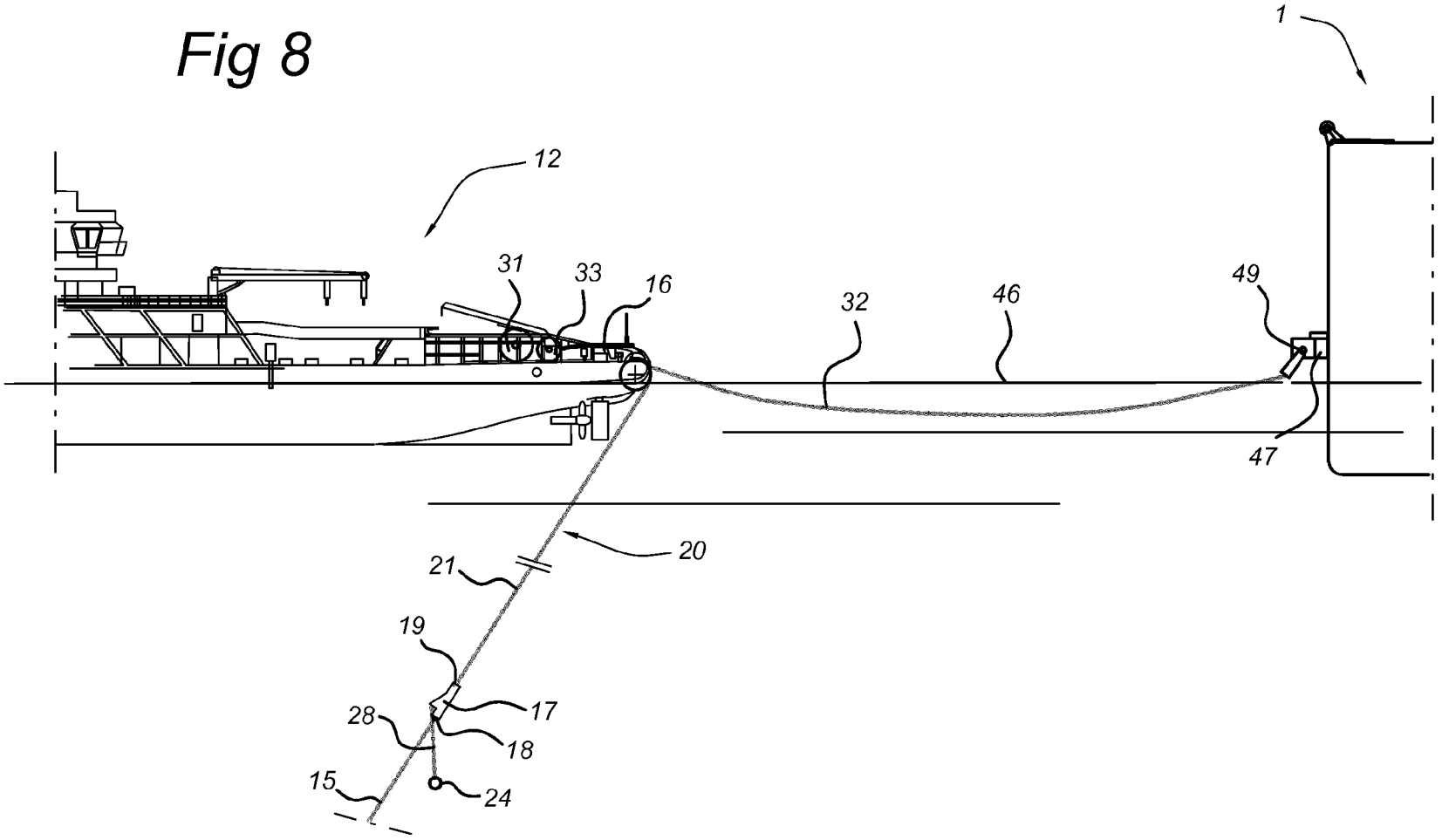
FIG. 8 shows side view of the anchor line handling vessel in the position of connection of the installation chain part to the pendant chain.
Figure 9:
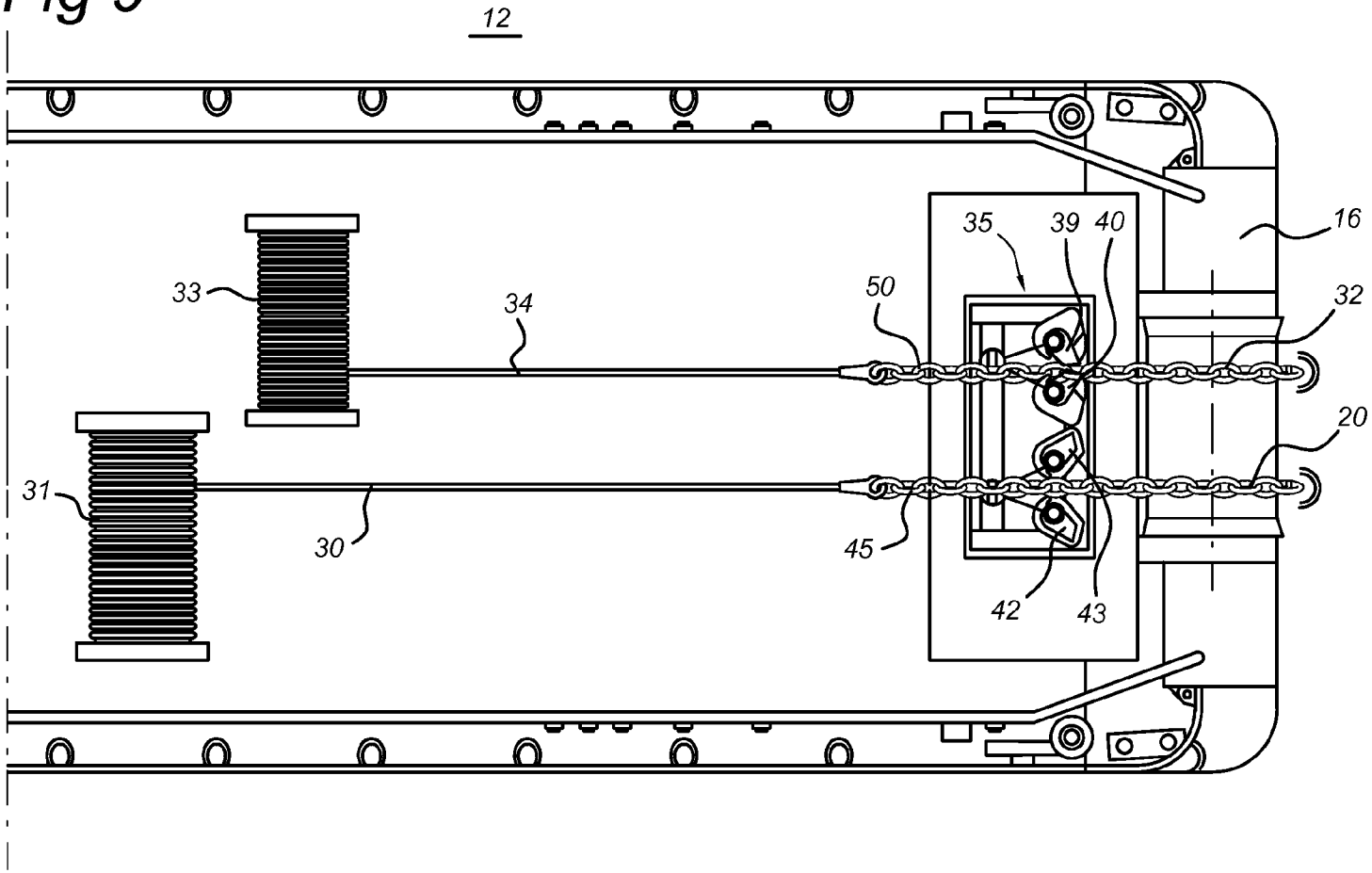
FIGS. 9 and 10 show top plan views of the stern part of the anchor line handling vessel upon interconnecting the installation chain part and the pendant chain.

As shown in FIGS. 8 and 9, the vessel 12 moves away from the FPSO 1 a little under 200 m such that the depth of the pendant chain 32 below water level 46 is about 40 m.

Figure 10:
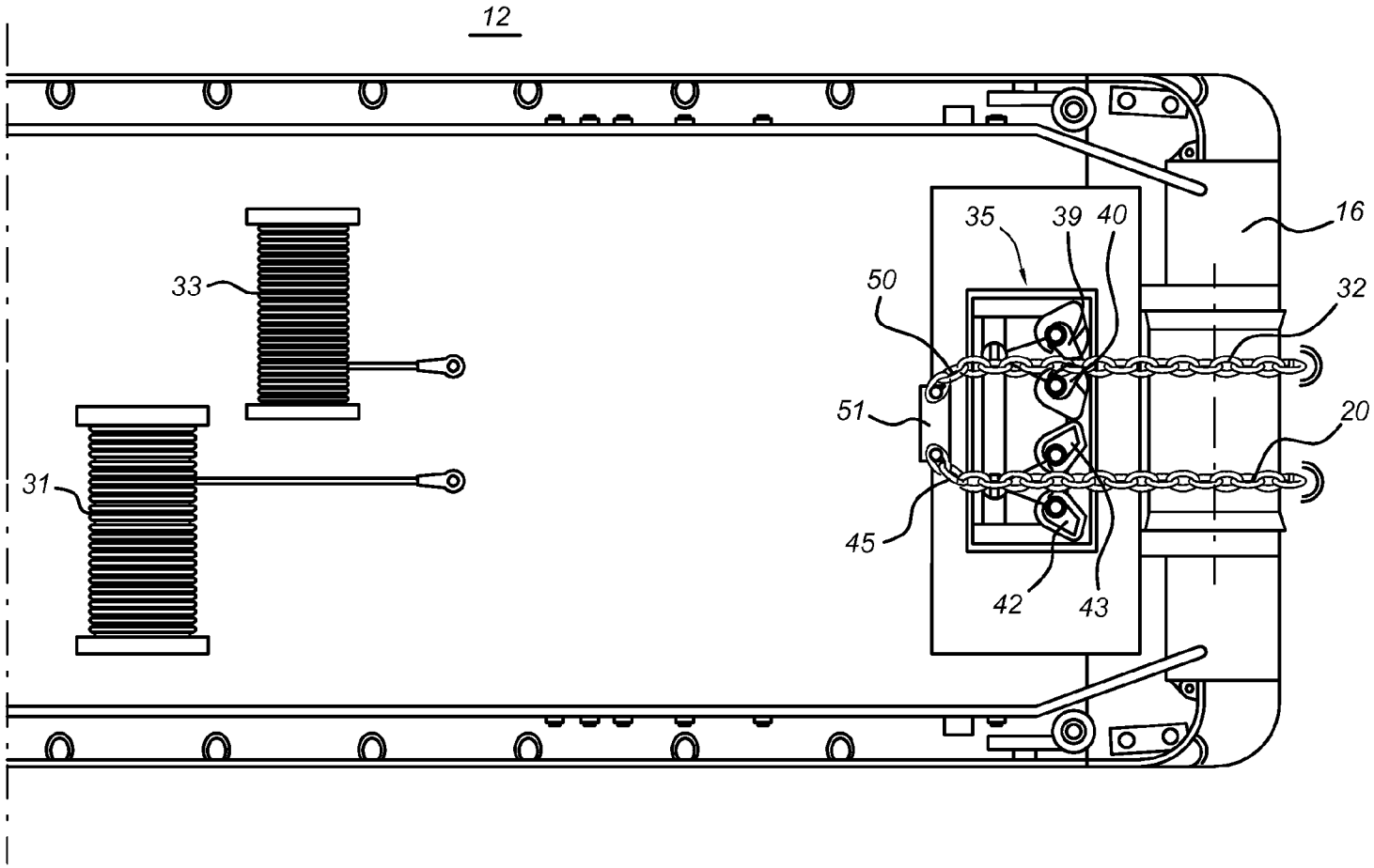

The tension in the pendant chain may be around 40 T while the stern thrust of the anchor-line handling vessel is about 15 T. The fixed end of pendant chain 32 is attached to the anchoring point 47 on the hull of the FPSO 1 via a universal joint 49. The free end 45 of the working chain 20 and the free end 50 of the pendant chain 32 are both held by the clamping device 35 at a close mutual distance, as can be seen in FIGS. 9 and 10, such that they can be easily interconnected on the deck by a connector member 51 which may comprise for instance two interconnected bow shackles acting on the open chain links at the end of chains 32 and 20.

Figure 11:
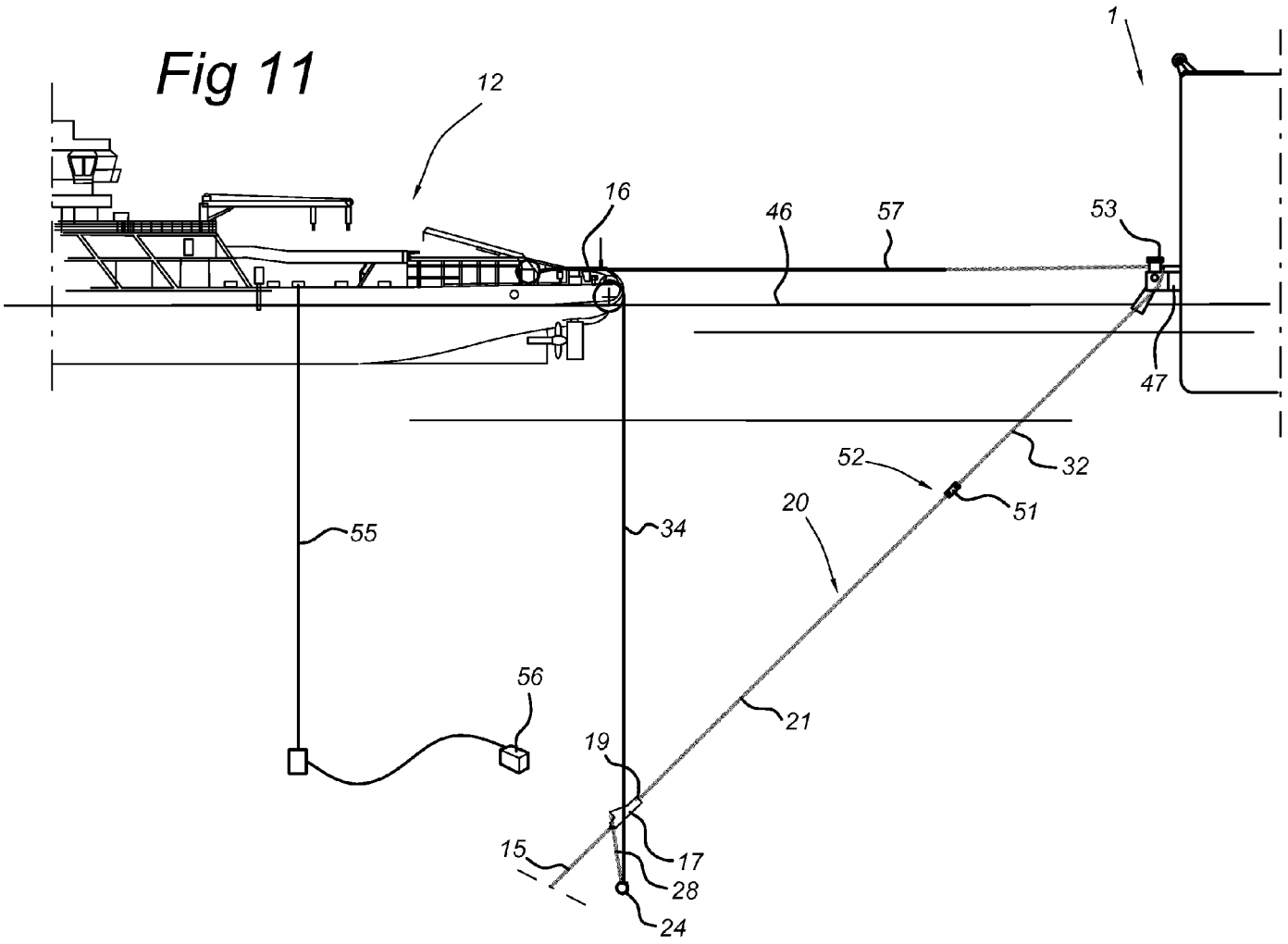
FIG. 11 shows a side view of the hook up of the tensioning chain part and a holding hawser to the anchor line handling vessel.

Next, as can be seen in FIG. 11 the clamping device 35 is opened and the jaws 39,40; 43, 42 are simultaneously released such that interconnected chains 20, 32 are over boarded.

At the interconnect position 52 of the chains 32, 20, on the end of the pendant chain 32, the connector member 51 is situated. The anchor line-handling vessel 12 is moved with its stern towards the FPSO to recover a holding hawser 57, attached to the FPSO 1 in a holding point 53 on the hull of the FPSO 1, situated near anchoring point 47. The free end of the hawser 57 is connected to the work wire 30 and main which 31. Next, a remotely operated vehicle (ROV) 56, connected to the vessel 12 via an umbilical 55, is over boarded and attaches tugger winch wire 34 to the pulling eye 24 of tensioning chain part 28.

Figure 12:
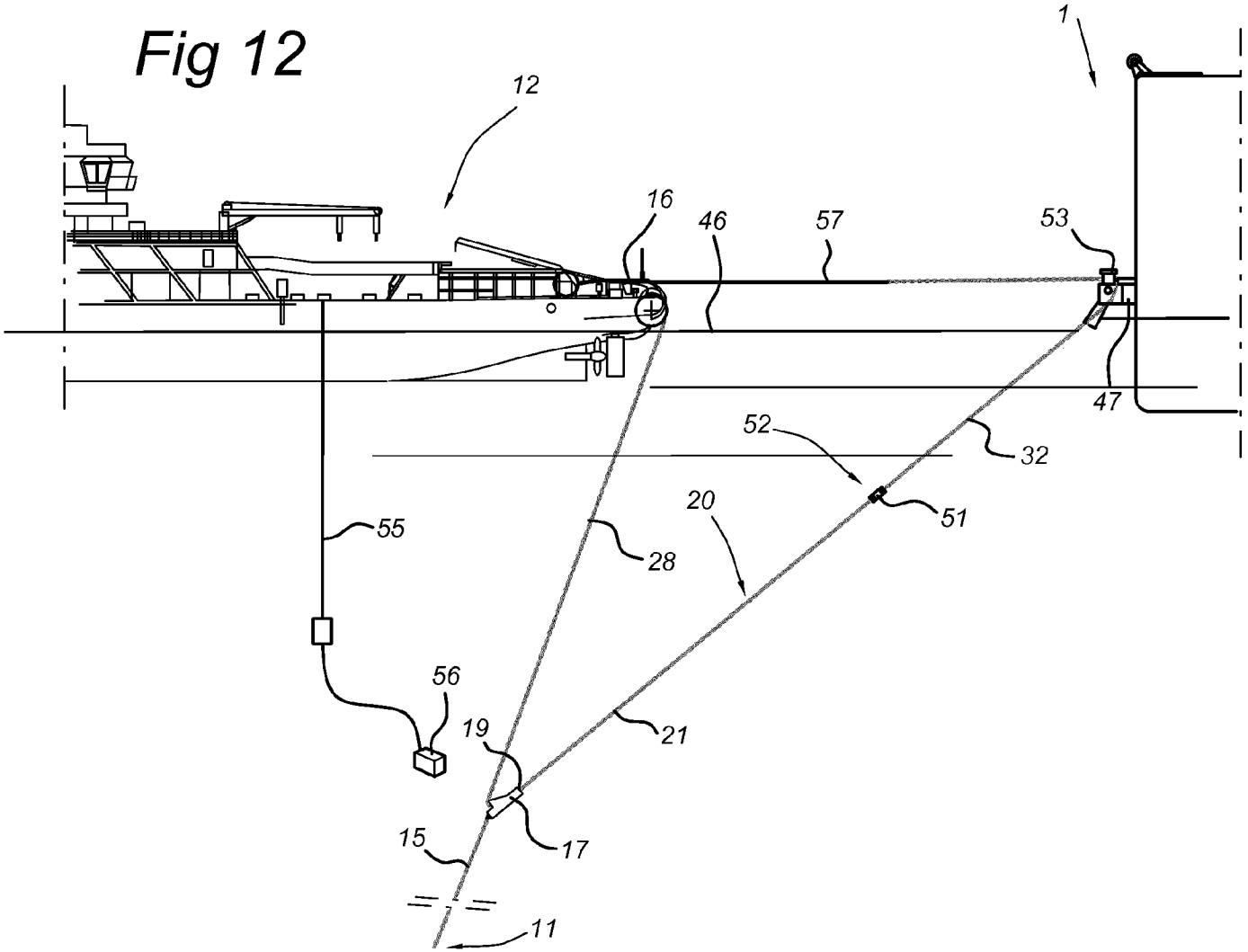
FIG. 12 shows a side view of the tensioning of the anchor line.

Then, as shown in FIG. 12, the tugger winch 33 is operated to pull in the tensioning chain part 28 to the required length or tension, e.g. 118 m and 30 T. In the present case, the anchor line 11 is of a relatively large length, such as several km, and the length of the tensioning chain part 28 in this case is relatively long to compensate for elongation of the anchor line. In case the anchor line 11 is shorter, for use in shallower waters, the length of the chain part 28 will be shorter.

Thereafter, the main winch 31 is operated to pull in the holding hawser 57 to tension the system. In FIG. 12, the depth of the chain tensioner 17 below water level 46 may be about 100 m, the length of the hawser 57 being about 60 m at a tension of 90 T, the upward tension in tensioning chain part 28 being 150 T at a length of about 75 m, the tension in the anchor leg 11 being about 260 T, the length of the pendant chain 32 and installation chain part 21 being about 120 m. The ROV 56 monitors the passage of the tensioning chain part 28 through the chain tensioner 17 until a reference chain link (having a predetermined distinctive characteristic, such as colour) reaches a preset position on the chain tensioner 17.

Figure 13:
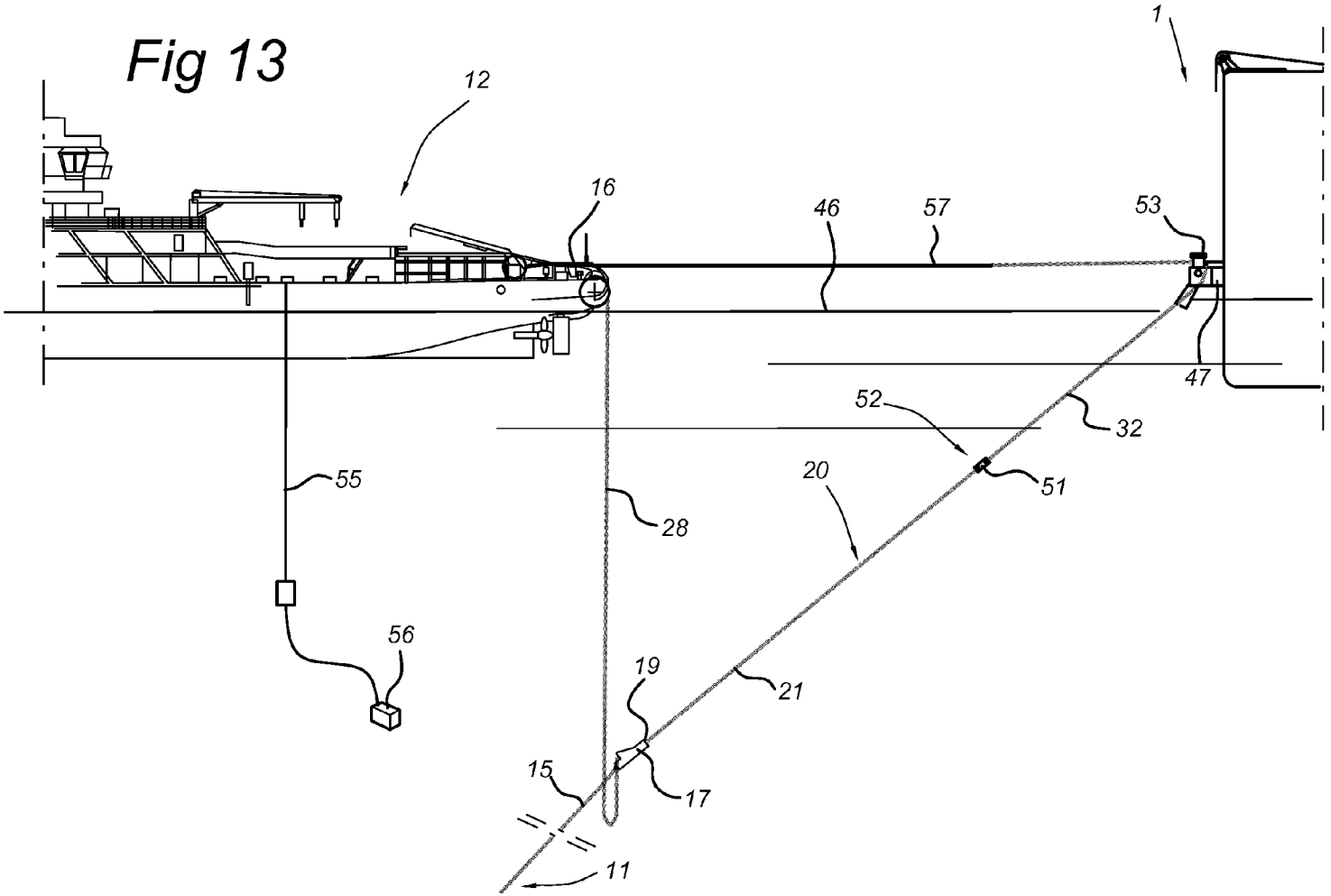
FIGS. 13 and 14 show side views of the disconnecting step of holding hawser and tensioning chain part from the anchor line handling vessel.
Figure 14:
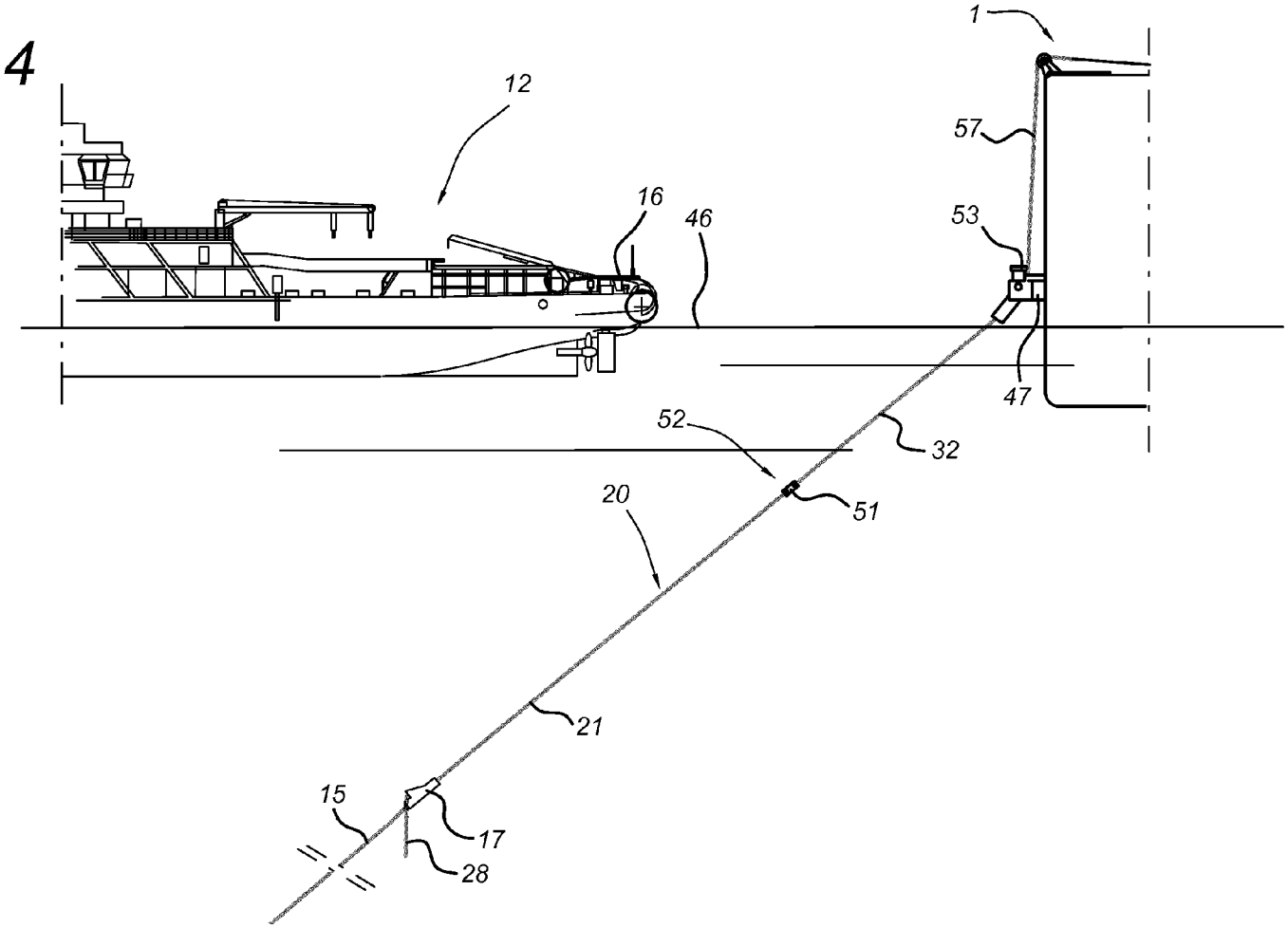

As can be seen in FIG. 13, the tensioning chain part 28 is thereafter lowered and detached, while the hawser 57 is returned to the FPSO 1, while remaining attached to the holding point 53, to complete the procedure.

Figure 15:
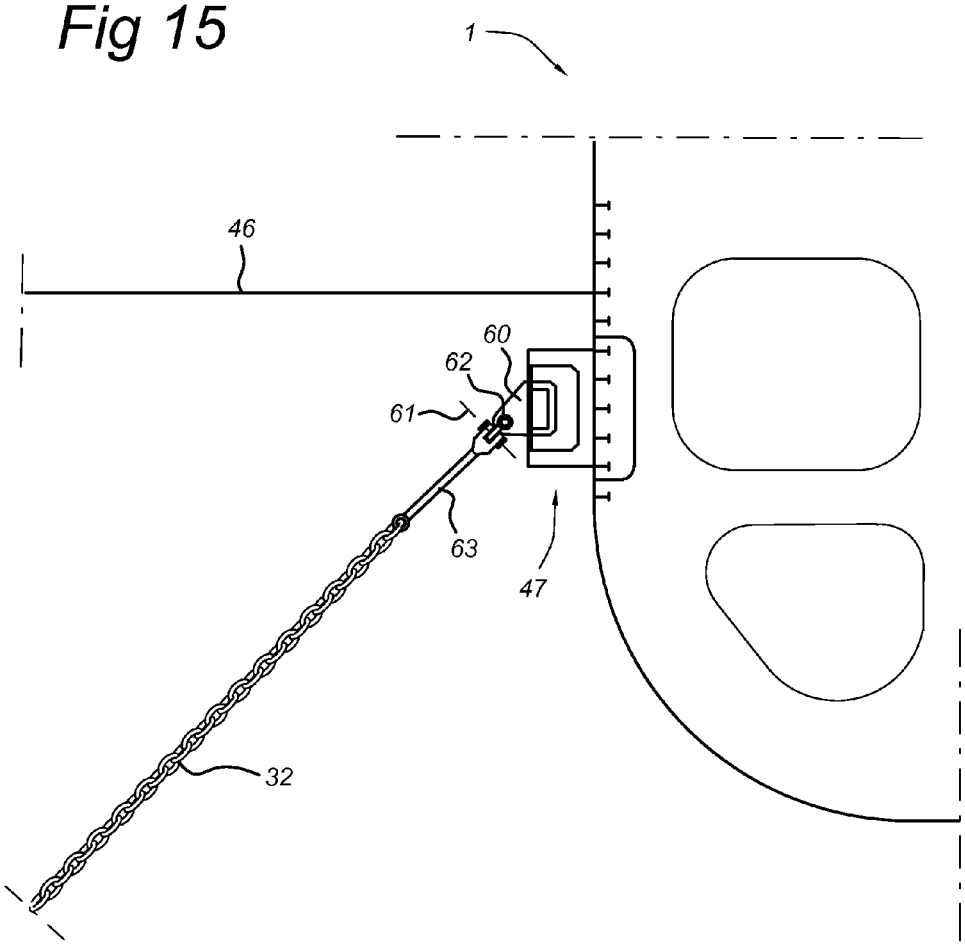
FIG. 15 shows an anchoring point on the hull of a moored offshore structure in the form of a uni-joint.

FIG. 15 shows the hull of the FPSO 1 having in anchoring point 47 a bracket attached to the outer hull carrying a flange 60. A 4 m long moment arm 63 is connected to the flange to form a universal joint, rotatable around axis 61 and around an axis extending perpendicular to the plane of the drawing in hinge point 62. The pendant 32 is fixed to the end of arm 63. In this case, the anchoring point is situated below water level

The invention claimed is:

1. Anchor line installation method for mooring an offshore structure (1) to a mooring line (7,8,11) comprising the steps of:

providing a mooring line (11), with one end connected to a sea bed and comprising at a free end (13,15) a connector member (14, 22), lifting the free end (13,15) onto a deck of an anchor line handling vessel (12), connecting on the anchor line handling vessel a chain tensioner (17) with a connection side (18) to the connector member (14,22), providing a working chain (20) into the entry side (19) of the chain tensioner (17), the working chain having a tensioning chain part (28) and a installation chain part (21), the tensioning chain part being shorter than the installation chain part, holding a free end of the installation chain part (21) connected to the anchor line handling vessel while lowering the chain tensioner (17) below water level (46), picking up a free end of a pendant (32) attached on one end to the offshore structure that is to be moored, and attaching the free end of the pendant (32) to the free end of the installation chain part (21) in an interconnect position (52) on the anchor line handling vessel (12) and, placing the interconnect position (52) overboard from the anchor handling vessel (12), connecting a lifting cable (34) of a lifting device (33) on the anchor line handling vessel (12) to the tensioning chain part (28) below water level, and Exerting an upward tensioning force on the tensioning chain part (28) via the lifting cable (34).

2. Method according to claim 1, wherein an upward tensioning force on the tensioning chain part (28) is derived from operating the lifting device (33) on the anchor line handling vessel (12).

3. Method according to claim 1, wherein the installation chain part (21) of the working chain (20) is at least 0.5 times the length of the pendant (32).

4. Method according to claim 1, wherein the anchor line handling vessel (12) is connected to the offshore structure (1) in a holding point (53) via a holding line (57) that is connected to a pulling device (31) on the anchor line handling vessel, wherein an upward tensioning force is exerted on the tensioning chain part (28) by the pulling device (31) exerting a pulling force on the anchor line handling vessel (12) in the direction of the offshore structure (1) via the holding line (57).

5. Method according to claim 4, wherein the length of the holding line (57) is shorter than a horizontal distance of the chain tensioner (17) from the holding point (53) such that the tensioning chain part (28) line extends substantially in line with the mooring line (11).

6. Method according to claim 4, wherein the holding point (53) is situated above water level (46).

7. Method according to claim 6, wherein the holding point (53) is situated substantially at the height of the anchor line handling vessel such that the holding line has a substantially horizontal orientation.

8. Method according to claim 1, wherein the mooring line (11) is for its larger part made of a synthetic material.

9. Method according to claim 5, wherein the holding point (53) is situated above water level (46).

10. Method according to claim 8 wherein the synthetic material comprises a polyester wire rope material.

* * * * *